US011643841B2

(12) United States Patent
Jean et al.

(10) Patent No.: US 11,643,841 B2
(45) Date of Patent: May 9, 2023

(54) PUSH-AND-PULL LATCH DEVICE

(71) Applicant: Wen-Fong Jean, Taoyuan (TW)

(72) Inventors: Wen-Fong Jean, Taoyuan (TW); Tai-Lien Huang, Taoyuan (TW); Chen-Kuo Chen, Taoyuan (TW)

(73) Assignee: Wen-Fong Jean, Taoyuan (TW)

( * ) Notice: Subject to any disclaimer, the term of this patent is extended or adjusted under 35 U.S.C. 154(b) by 441 days.

(21) Appl. No.: 17/091,518

(22) Filed: Nov. 6, 2020

(65) Prior Publication Data

US 2021/0189763 A1 Jun. 24, 2021

(30) Foreign Application Priority Data

Dec. 19, 2019 (TW) ..... 108146629

(51) Int. Cl.

| | |
|---|---|
| ***E05B 15/10*** | (2006.01) |
| ***E05B 55/00*** | (2006.01) |
| ***E05B 63/00*** | (2006.01) |
| ***E05B 63/22*** | (2006.01) |
| *E05B 65/46* | (2017.01) |

(52) U.S. Cl.

CPC ..... *E05B 15/101* (2013.01); *E05B 55/00* (2013.01); *E05B 63/0065* (2013.01); *E05B 63/22* (2013.01); *E05B 65/46* (2013.01)

(58) Field of Classification Search

CPC .... E05B 15/101; E05B 55/00; E05B 63/0065; E05B 63/22; E05B 65/46; E05B 1/0038; E05B 65/44; E05C 1/14

See application file for complete search history.

(56) References Cited

U.S. PATENT DOCUMENTS

| | | | | |
|---|---|---|---|---|
| 10,184,270 | B2 * | 1/2019 | Bullwinkel | E05B 73/00 |
| 2006/0255596 | A1 * | 11/2006 | Yong | E05C 1/14 292/173 |
| 2007/0001559 | A1 * | 1/2007 | Chen | G06F 1/181 312/223.2 |

* cited by examiner

*Primary Examiner* — Kristina R Fulton
*Assistant Examiner* — Thomas L Neubauer
(74) *Attorney, Agent, or Firm* — Kirton McConkie; Evan R. Witt

(57) ABSTRACT

The disclosure relates to a push-and-pull latch device including a housing, a latching component, a first elastic component, an inner-sleeve assembly, an inner-shaft component, a second elastic component and a third elastic component. The first elastic component abuts the latching component. The latching component engages an object through the housing. The inner-sleeve assembly is accommodated within the housing. The inner-shaft component is partially accommodated within the inner-sleeve assembly. The second elastic component is abutted between the inner-shaft component and the inner-sleeve assembly. The third elastic component includes a fixed portion connected to the inner-shaft component and an engaging end engaged with a guide groove of the inner-sleeve assembly. By driving the inner-shaft component to move the engaging end relative to the guide groove or move the inner-sleeve assembly relative to the housing, the relative positions between the components can be switched to provide the functions of opening and closing.

15 Claims, 14 Drawing Sheets

PUSH-AND-PULL LATCH DEVICE

FIELD OF THE INVENTION

The present disclosure relates to a latch device, and more particularly to a push-and-pull latch device applied to a door lock or a drawer lock.

BACKGROUND OF THE INVENTION

Doors, windows, or furniture in human life often have a set of components which need to be opened or closed with each other. In addition to maintaining the function of opening and closing, the components also need to be locked by a latch device.

The design of the conventional latch device is limited due to the operation direction or the connection with the handle. A sufficient operating space must be provided for the operation of the latch device. For a latching device utilized in a limited space, such as a door lock or a drawer lock disposed on a transportation vehicle, if the operating space of the latch device is larger, it cannot meet the practical requirements.

On the other hand, the latch device is applied to an object not only for opening and closing operations thereof, but also providing a locking function. The conventional latch device uses a simple tongue-and-slot component to achieve positioning and locking functions. In order to achieve the positioning and locking function at different positions, the conventional latch device often includes a plurality of elastic tongue-and-slot components. Hence, the overall structure of the conventional latch device is complex, and it is difficult to assemble and maintain.

Therefore, it is necessary to provide a push-and-pull latch device applied to a door lock or a drawer lock, to achieve the overall structure to be assembled and maintained easily, and be operated in a limited operating space to solve the foregoing problems and overcome the above drawbacks.

SUMMARY OF THE INVENTION

An object of the present disclosure is to provide a push-and-pull latch device applied to a door lock or a drawer lock. With operations of an inner-shaft component and an inner-sleeve assembly, engaging portions of related components are driven to space apart or engage. In that, the latch device is driven by a simple pressing action in a limited operating space and it is conducive to achieving the functions of opening, closing or locking a door or a drawer. The overall structure is compact. It is easy to assemble, maintain and operate.

Another object of the present disclosure is to provide a push-and-pull latch device applied to a door lock or a drawer lock. The latch device has a compacted structure, and can be assembled easily. By driving the inner-shaft component and the elastic components to move relative to a guiding groove of the inner-sleeve assembly or the housing, the relative positions of the related components are switched. The operation component of the latch device can be hidden or held, and the user can drive the engaging portions of the related components in the latch device to space apart or engage by a simple pressing action. It is conducive to achieving the functions of opening, closing or locking a door or a drawer.

A further object of the present disclosure is to provide a push-and-pull latch device applied to a door lock or a drawer lock. Positioning of the inner-shaft component and the inner-sleeve assembly is further implemented by the movement of the elastic component relative to the guiding groove of the inner-sleeve assembly or the housing, to replace the conventional elastic tenon assembly. The complexity and difficulty of assembly are simplified effectively. The guiding groove includes a plurality of inclined surfaces segmented to form a non-reverse sawtooth structure. It is beneficial for one end of the elastic component to constantly abut the guiding groove, and to move steadily along the guiding groove to be positioned at a specific position. In that, the engaging portions of the related components are driven to space apart or engage, to achieve the operations of opening, closing or locking. Compared with the conventional tenon structure, the combination of the elastic component and the guiding groove is easier to assemble, replace or maintain. It enhances the competitiveness of the push-and-pull latch device effectively.

According to an aspect of the present disclosure, there is a push-and-pull latch device for being disposed on an object. The object includes a movable component and a fixed component. The movable component includes an installation opening. The push-and-pull latch device includes a housing, a latching component, two first elastic components, an inner-sleeve assembly, an inner-shaft component, a second elastic component and a third elastic component. The housing is fixed to the movable component. The housing includes an accommodation seat and a lateral opening. The lateral opening is in communication with the accommodation seat. The latching component includes a latching portion, two arms and two first engaging portions. The two arms spatially correspond to each other, the latching portion is connected to the two arms, the two first engaging portions are disposed on two corresponding sides of the two arms, and the latching portion spatially corresponds to the lateral opening. The two first elastic components spatially correspond to the two arms and are disposed between the housing and the corresponding one of the two arms. The first elastic component is constantly abutted between the corresponding one of the two arms and the housing, so that when the latching portion is passed through the lateral opening and engaged with the fixed component, the movable component is blocked from moving relative to the fixed component. The inner-sleeve assembly is detachably accommodated within the accommodation seat and located between the two corresponding sides of the two arms. The inner-sleeve assembly includes an accommodation space, a bottom portion, a first opening, two limiting portions, at least one second engaging portion and a guiding groove. The two limiting portions spatially correspond to the two first engaging portions. The first opening spatially corresponds to the bottom portion and is communication with the accommodation space. The guiding groove faces to the accommodation space. The at least one second engaging portion is disposed adjacent to the first opening, and the guiding groove includes a first fastening recess and a second fastening recess. The inner-shaft component spatially corresponds to the installation opening. The inner-shaft component is partially accommodated within the accommodation space of the inner-sleeve assembly, and includes a fixing space and at least one third engaging portion. The at least one third engaging portion is disposed on a bottom end of the inner-shaft component and spatially corresponds to the at least one second engaging portion. The second elastic component includes a first end connected to the bottom portion of the inner-sleeve assembly and a second end accommodated within the fixing space of the inner-shaft component. The second elastic component is constantly abutted between the inner-shaft component and the inner-sleeve assembly, so that the at least one third engaging portion is engaged with the at least one second engaging portion. The third elastic component includes a fixed portion and an engaging end. The fixed portion is accommodated within the fixing space. The engaging end constantly abuts the guide groove. When the second elastic component is constantly abutted between the inner-shaft component and the inner-sleeve assembly, the at least one third engaging portion is engaged with the at least one second engaging portion, and the engaging end is located at the first fastening recess. When the inner-shaft component is driven to abut the second elastic component and move the engaging end to the second fastening recess of the guiding groove, the at least one third engaging portion is separated from the at least one second engaging portion.

In an embodiment, when the inner-sleeve assembly is located at a first position relative to the accommodation seat, the two limiting portions and the two first engaging portions are engaged with each other, and the latching portion passes through the lateral opening and is engaged with the fixed component. When the inner-sleeve assembly is moved to a second position relative the accommodation seat, the two limiting portions drive the latching component to abut the two first elastic components through the two first engaging portions, and the latching portion is moved into the housing through the lateral opening, so that the latching portion and the fixed component are separated.

In an embodiment, the push-and-pull latch device further includes a stopper disposed on the fixed component and spatially corresponding to the latching portion of the latching component. When the latching component passes through the lateral opening, the latching component and the stopper are engaged with each other, so as to block the movable component from moving relative to the fixed component.

In an embodiment, the stopper further includes at least one first fastening component configured to fasten the stopper on the fixed component.

In an embodiment, the inner-shaft component includes an installation end and an operation component. The operation component is disposed on the installation end, spatially corresponds to the installation opening, and is exposed out of the movable component through the installation opening, so as to facilitate a user to push/pull the operation component.

In an embodiment, the push-and-pull latch device further includes an adjusting component having an accommodation opening and spatially corresponding to the installation opening. When the engaging end is moved to the second fastening recess of the guiding groove, the operation component is received within the accommodation opening. When the inner-shaft component drives the inner-sleeve assembly to move into the second position relative to the accommodation seat, the operation component is moved and exposed out of the accommodation opening.

In an embodiment, the housing further includes a cover having a second opening, and the inner-shaft component passes through the second opening.

In an embodiment, the housing further includes at least one second fastening component configured to fasten the housing on the movable component.

In an embodiment, the guiding groove includes a first channel and a second channel, the first channel is communicated between the first fastening recess and the second fastening recess, and the second channel is communicated between the second fastening recess and the first fastening recess.

In an embodiment, the first channel includes a plurality of inclined surfaces, and each of the inclined surfaces of the first channel increases in height along a direction from the first fastening recess to the second fastening recess.

In an embodiment, the second channel includes a plurality of inclined surfaces, and each of the inclined surfaces of the second channel increases in height along a direction from the second fastening recess to the first fastening recess.

In an embodiment, the two limiting portions include a triangular opening, respectively.

In an embodiment, when the latching portion of the latching component is subjected to a force and driven to push the two first elastic components, the latching portion is moved to pass through the lateral opening and received within the housing.

In an embodiment, the two first elastic components and the second elastic component includes a telescopic spring, respectively.

In an embodiment, the third elastic component includes a metal elastic component.

The above objects and advantages of the present disclosure become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only; it is not intended to be exhaustive or to be limited to the precise form disclosed.

Figure 1:
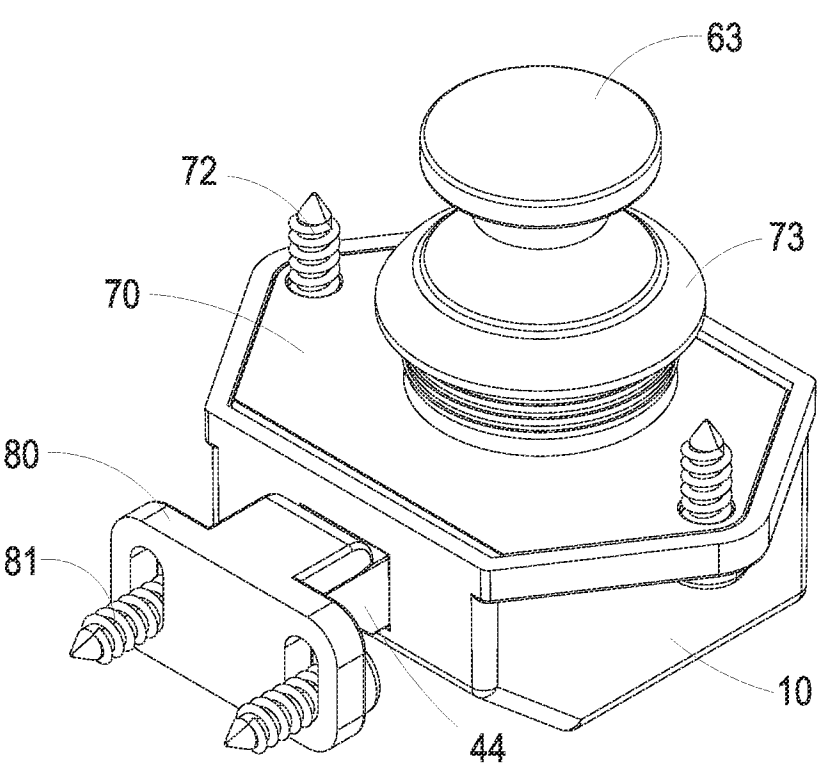
FIG. 1 is a perspective view illustrating a push-and-pull latch device according to an embodiment of the present disclosure.
Figure 2:
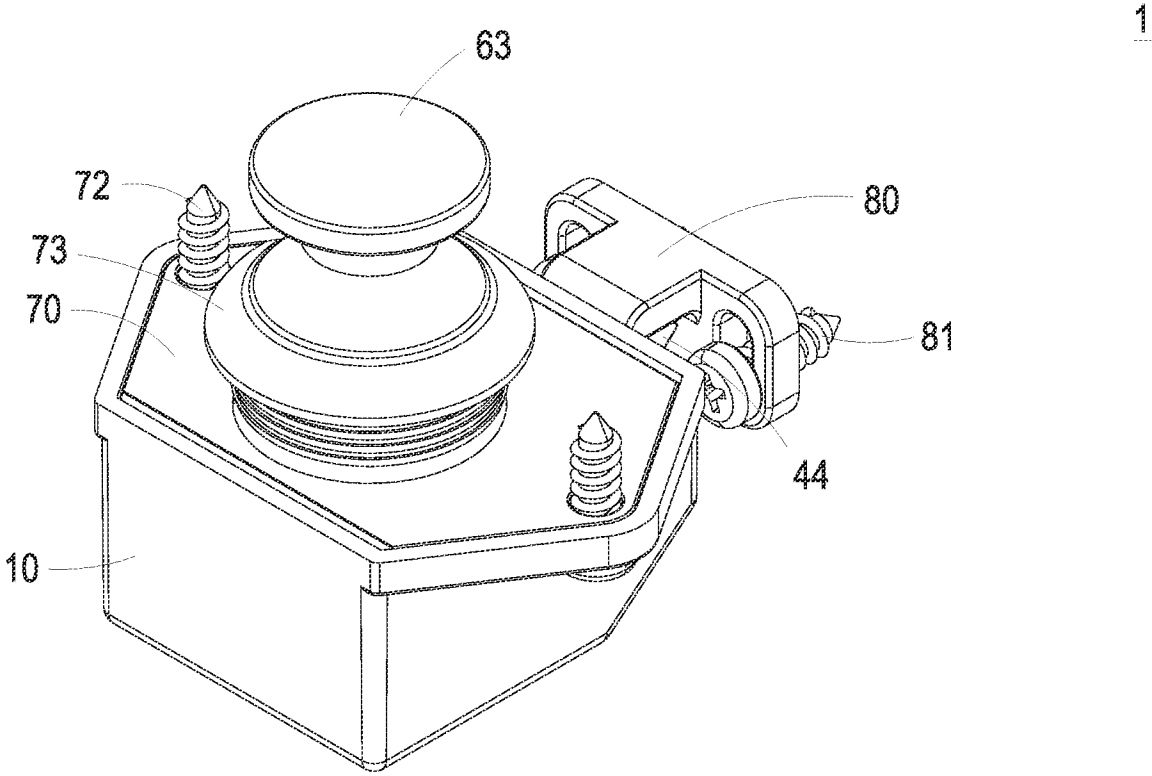
FIG. 2 is a perspective view illustrating the push-and-pull latch device according to the embodiment of the present disclosure and taken from another perspective.
Figure 3:
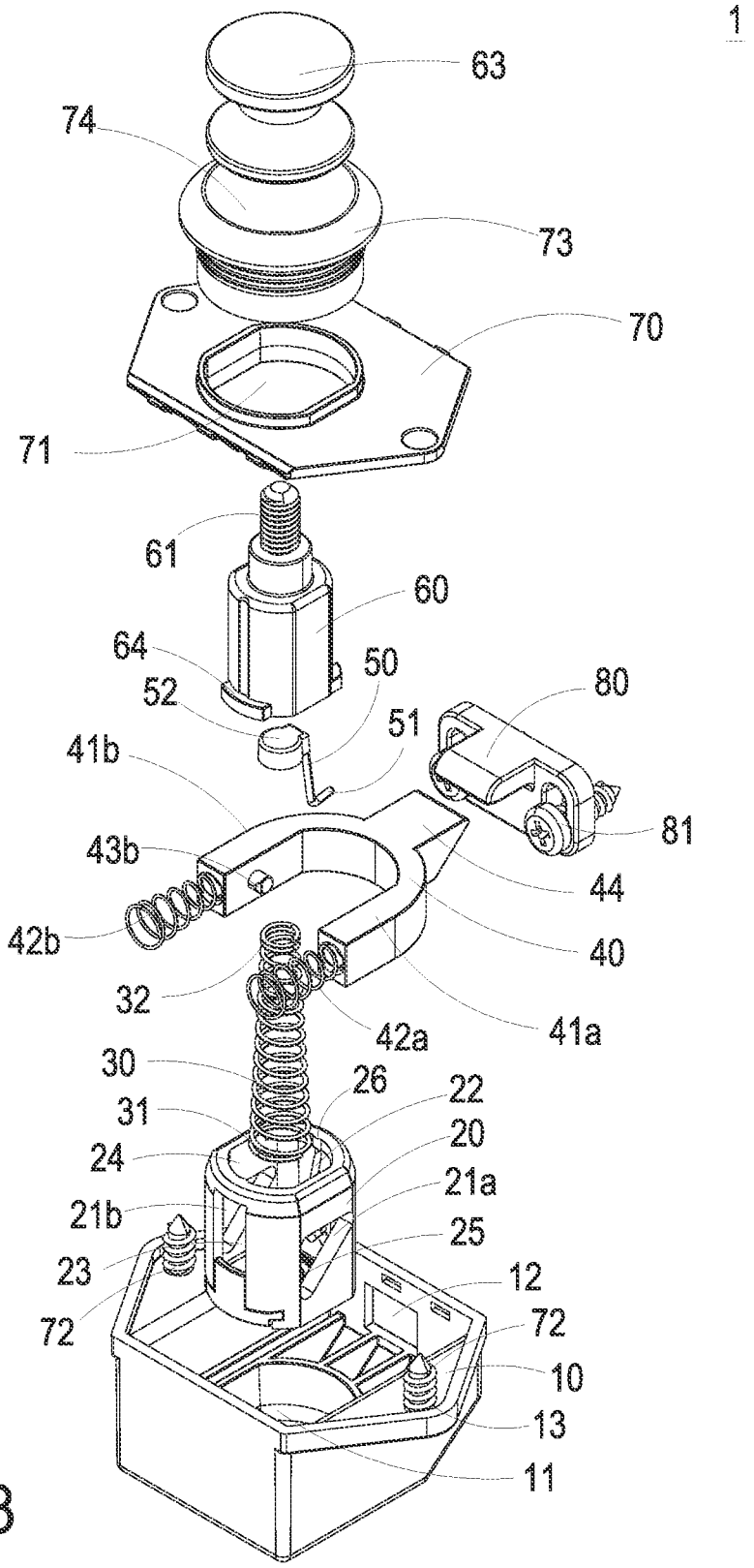
FIG. 3 is an exploded view illustrating the push-and-pull latch device according to the embodiment of the present disclosure.
Figure 4:
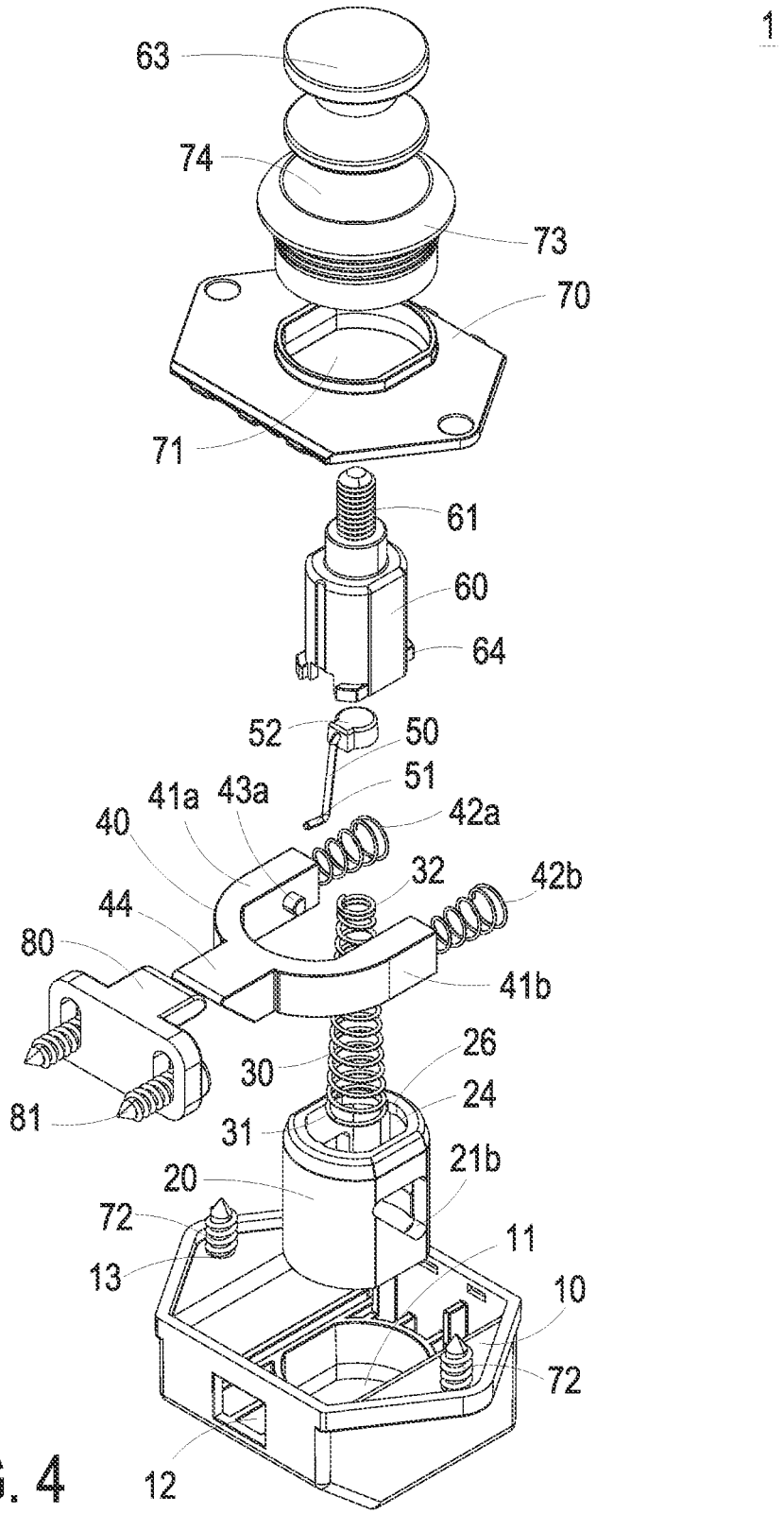
FIG. 4 is an exploded view illustrating the push-and-pull latch device according to the embodiment of the present disclosure and taken from another perspective.
Figure 5:
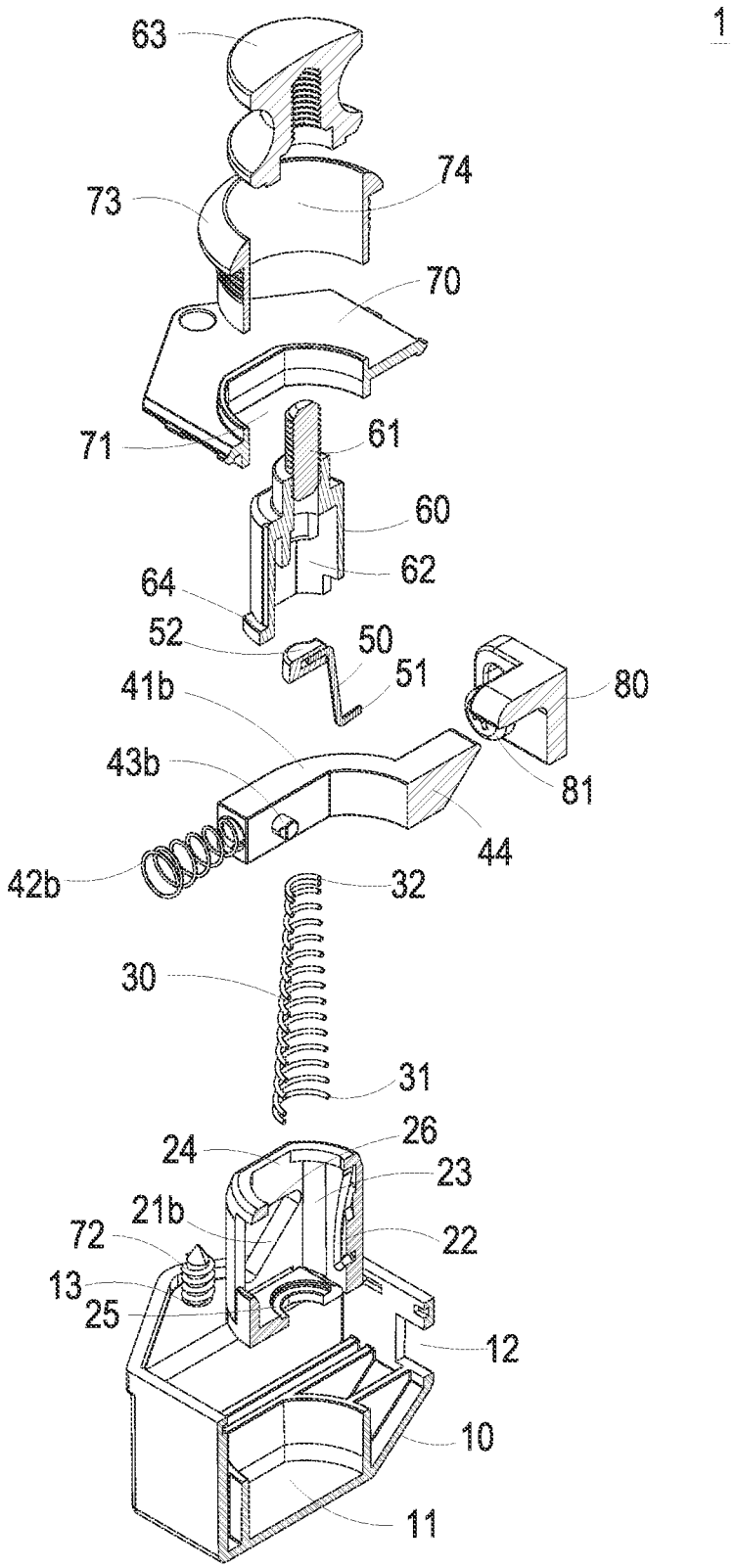
FIG. 5 is a cross-sectional structure illustrating the push-and-pull latch device according to the embodiment of the present disclosure.
Figure 6:
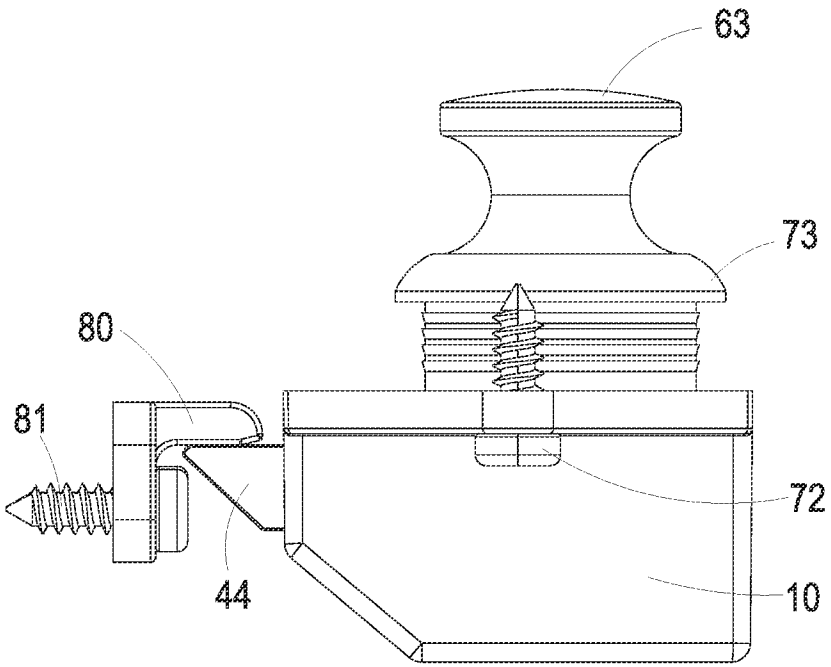
FIG. 6 is a lateral view illustrating the push-and-pull latch device when the inner-sleeve assembly is located at a first position relative to the accommodation seat and the engaging end of the third elastic component is located at a first fastening recess.
Figure 7:
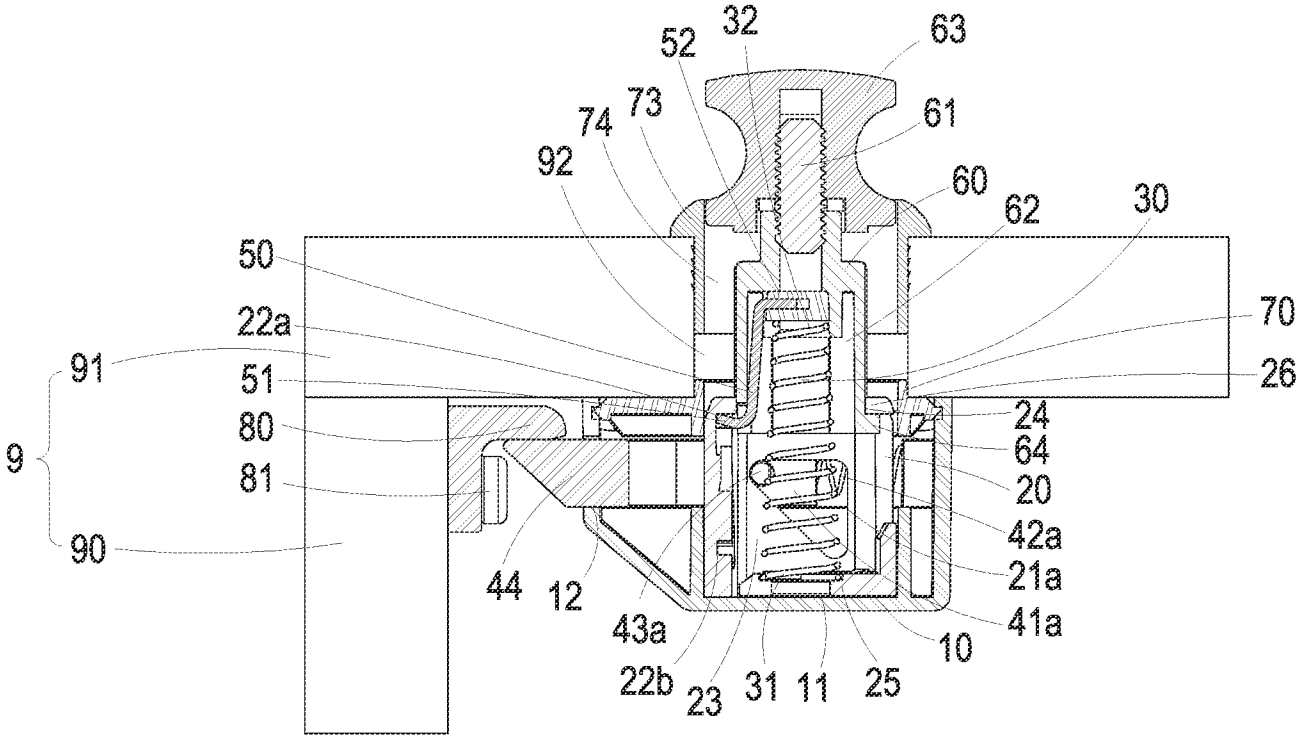
FIG. 7 is a cross-sectional view illustrating the push-and-pull latch device of FIG. 6 and applied to an object.
Figure 8:
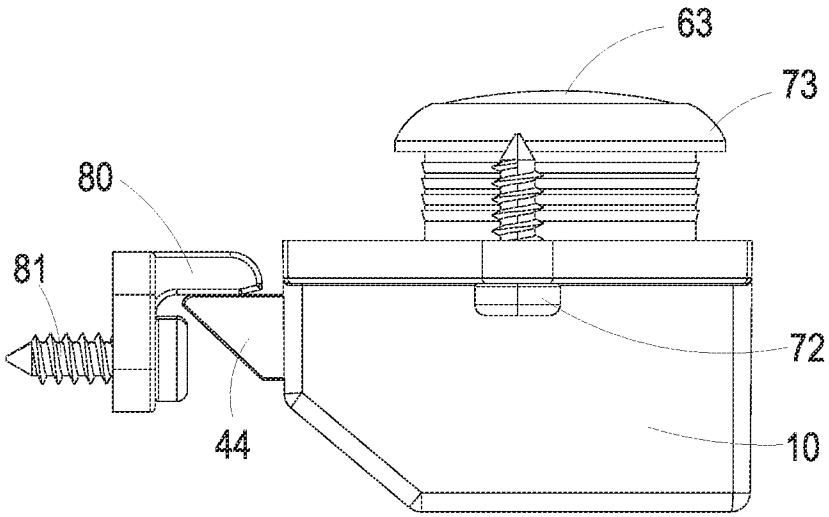
FIG. 8 is a lateral view illustrating the push-and-pull latch device when the inner-sleeve assembly is located at the first position relative to the accommodation seat and the engaging end of the third elastic component is located at a second fastening recess.
Figure 9:
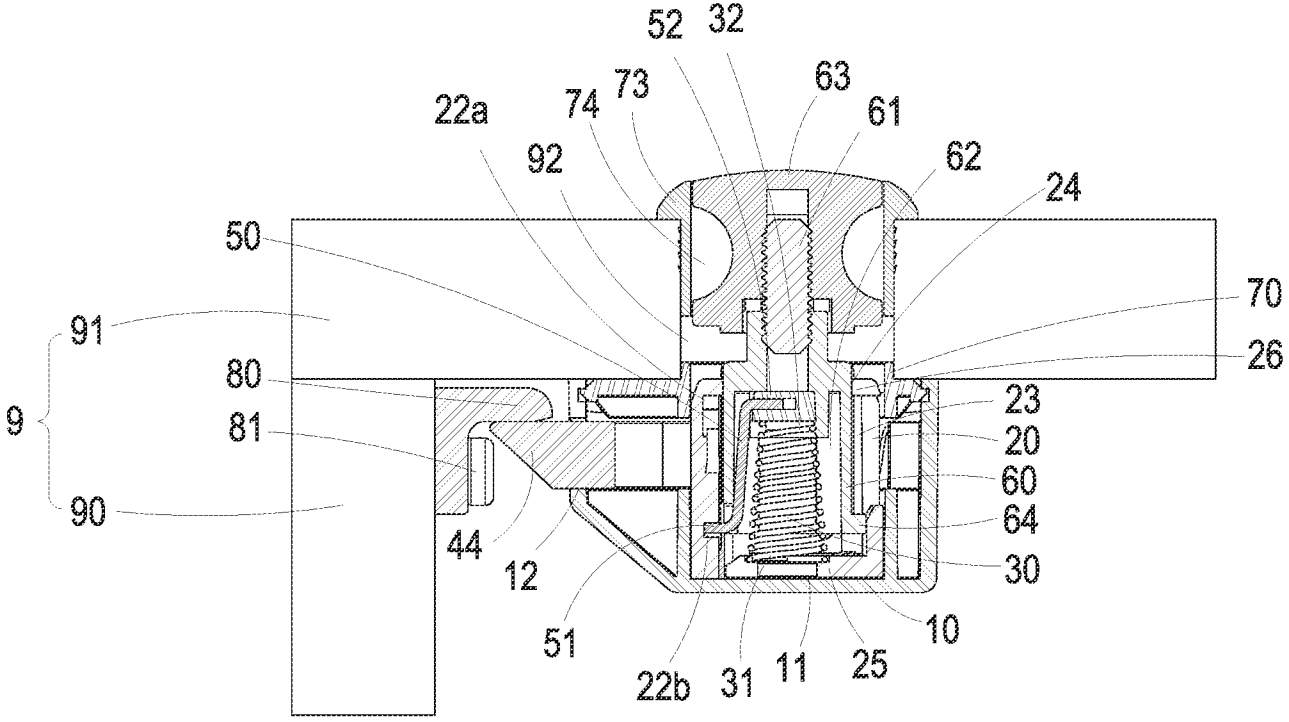
FIG. 9 is a cross-sectional view illustrating the push-and-pull latch device of FIG. 8 and applied to the object.
Figure 10:
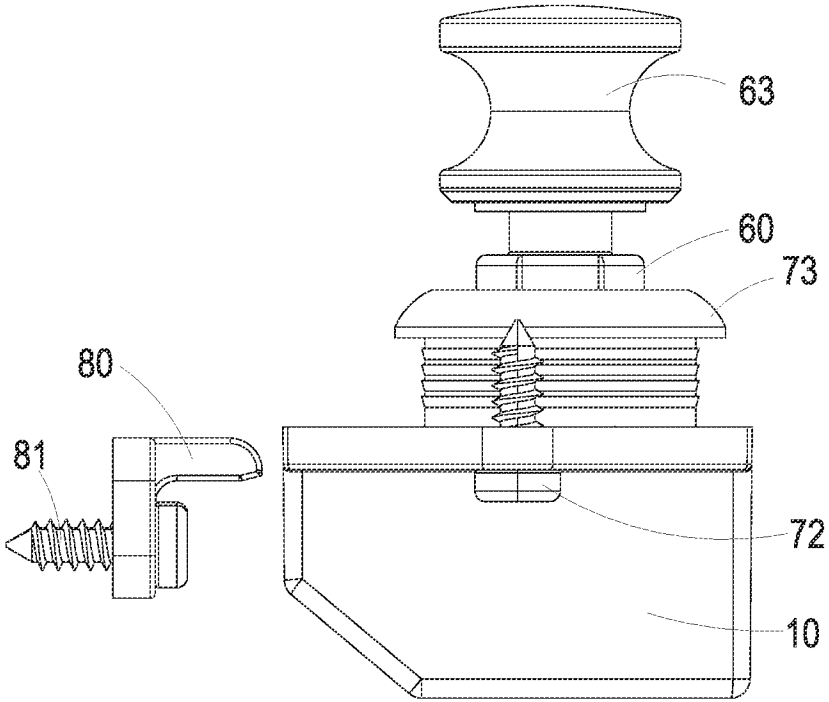
FIG. 10 is a lateral view illustrating the push-and-pull latch device when the inner-sleeve assembly is located at a second position relative to the accommodation seat and the engaging end of the third elastic component is located at the first fastening recess.
Figure 11:
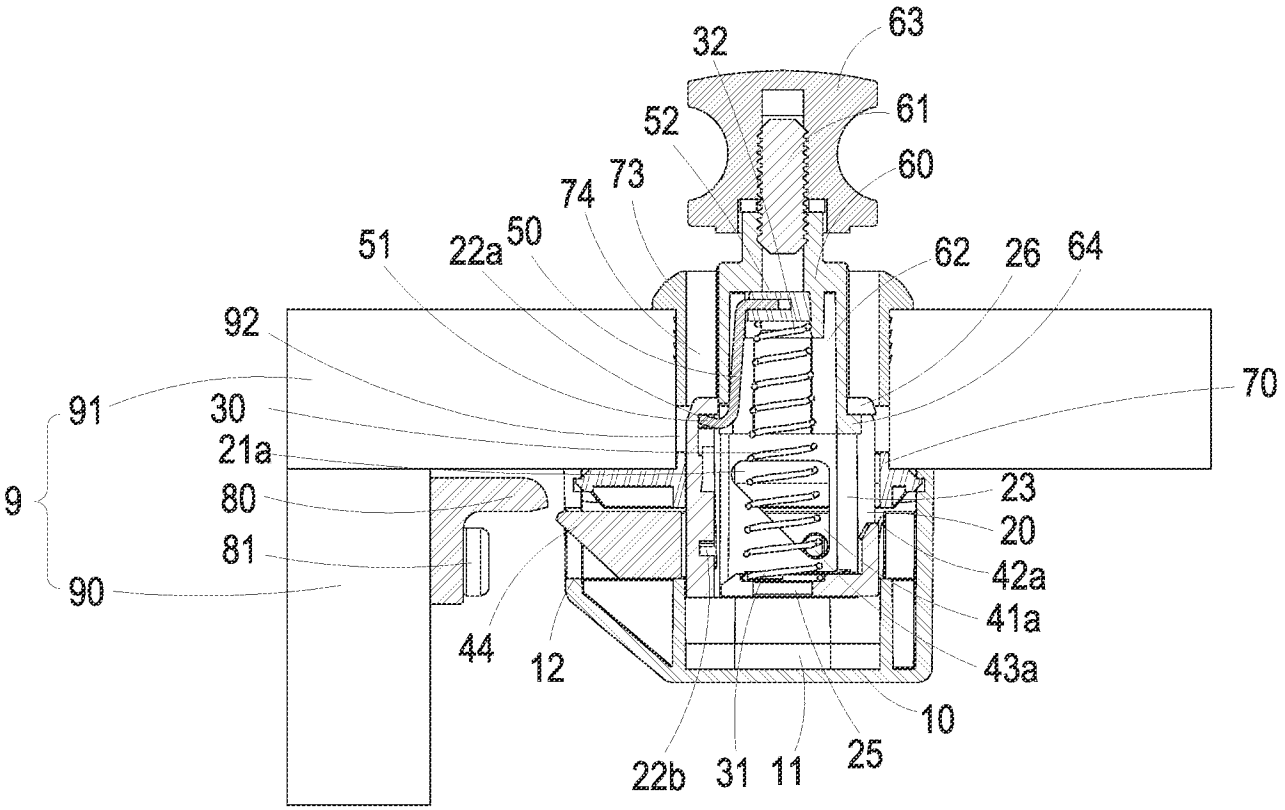
FIG. 11 is a cross-sectional view illustrating the push-and-pull latch device of FIG. 10 and applied to the object.

FIGS. 1 and 2 are perspective views illustrating a push-and-pull latch device according to an embodiment of the present disclosure. FIGS. 3 and 4 are exploded views illustrating the push-and-pull latch device according to the embodiment of the present disclosure. FIG. 5 is a cross-sectional structure illustrating the push-and-pull latch device according to the embodiment of the present disclosure. FIG. 6 is a lateral view illustrating the push-and-pull latch device when the inner-sleeve assembly is located at a first position relative to the accommodation seat and the engaging end of the third elastic component is located at a first fastening recess. FIG. 7 is a cross-sectional view illustrating the push-and-pull latch device of FIG. 6 and applied to an object. FIG. 8 is a lateral view illustrating the push-and-pull latch device when the inner-sleeve assembly is located at the first position relative to the accommodation seat and the engaging end of the third elastic component is located at a second fastening recess. FIG. 9 is a cross-sectional view illustrating the push-and-pull latch device of FIG. 8 and applied to the object. FIG. 10 is a lateral view illustrating the push-and-pull latch device when the inner-sleeve assembly is located at a second position relative to the accommodation seat and the engaging end of the third elastic component is located at the first fastening recess. FIG. 11 is a cross-sectional view illustrating the push-and-pull latch device of FIG. 10 and applied to the object. In the embodiment, the push-and-pull latch device 1 is configured to be disposed on an object 9, for example but not limited to a door or a drawer. The object 9 includes a movable component 91 and a fixed component 90. Preferably but not exclusively, the push-and-pull latch device 1 is applied to a door lock. Preferably but not exclusively, the fixed component 90 is a door frame, and the movable member 91 is a door panel. In the embodiment, the movable component 91 includes an installation opening 92. The push-and-pull latch device 1 spatially corresponds to the installation opening 92 and is fixed on the movable component 91.

In the embodiment, the push-and-pull latch device 1 includes a housing 10, a latching component 40, two first elastic components 42*a*, 42*b*, an inner-sleeve assembly 20, an inner-shaft component 60, a second elastic component 30 and a third elastic component 50. The housing 10 is configured to be fixed to the movable component 91, and spatially corresponds to the installation opening 92 of the movable component 91. In the embodiment, the housing 10 includes an accommodation seat 11 and a lateral opening 12. The lateral opening 12 is in communication with the accommodation seat 11. Preferably but not exclusively, the housing 10 further includes a cover 70. The cover 70 includes a second opening 71. The second opening 71 spatially corresponds to the installation opening 92 and is disposed correspondingly. In the embodiment, the latching component 40 includes a latching portion 44, two arms 41*a*, 41*b* and two first engaging portions 43*a*, 43*b*. The two arms 41*a*, 41*b* spatially correspond to each other. Preferably but not exclusively, the two arms 41*a*, 41*b* are configured to form a symmetrical structure. Preferably but not exclusively, the latching portion 44 is a tongue structure, and connected to a connection end of two arms 41*a*, 41*b*, so that the two arms 41*a*, 41*b* have two corresponding sides facing to each other. In the embodiment, the two first engaging portions 43*a*, 43*b* are disposed on the two corresponding sides of the two arms 41*a*, 41*b*. In the embodiment, the latching portion 44 spatially corresponds to the lateral opening 12 of the housing 10, and is configured to pass through the lateral opening 12 partially, so that the latching portion 44 is engaged with the fixed component 90. Preferably but not exclusively, the two first elastic components 42*a*, 42*b* include a telescopic spring, respectively. In the embodiment, the two first elastic components 42*a*, 42*b* spatially correspond to the other ends of two arms 41*a*, 41*b* of the latching components 40 and are disposed between the housing 10 and the corresponding one of the two arms 41*a*, 41*b*. The first elastic component 42*a*, 42*b* is constantly abutted between the corresponding one of the two arms 41*a*, 41*b* and the housing 10, so that when the latching portion 44 of the latching component 40 is passed through the lateral opening 12 and engaged with the fixed component 90, the movable component 91 is blocked from moving relative to the fixed component 90. In that, it achieves the purpose of keeping the door or drawer closed. In the embodiment, the inner-sleeve assembly 20 is detachably accommodated within the accommodation seat 11 of the housing 10, and located between the two corresponding sides of the two arms 41*a*, 41*b*. Preferably but not exclusively, the inner-sleeve assembly 20 is selectively attached to or moved away from the accommodation seat 11 of the housing 10 in a vertical direction. In the embodiment, the inner-sleeve assembly 20 includes an accommodation space 23, a bottom portion 25, a first opening 24, two limiting portions 21*a*, 21*b*, at least one second engaging portion 26 and a guiding groove 22. Preferably but not exclusively, the two limiting portions 21*a*, 21*b* include a triangular opening, respectively, which is in communication with the accommodation space 23. The two limiting portions 21*a*, 21*b* spatially correspond to the two first engaging portions 43*a*, 43*b* of the latching component 40. The first opening 24 spatially corresponds to the bottom portion 25 and is located at the top end of the inner-sleeve assembly 20. The first opening 24 is in communication with the accommodation space 23. Preferably but not exclusively, the guiding groove 22 is concavely formed on an inner lateral wall of the inner-sleeve assembly 20. The guiding groove 22 faces to the accommodation space 23. The at least one second engaging portion 26 is disposed adjacent to the first opening 24. The guiding groove 22 includes a first fastening recess 22*a* and a second fastening recess 22*b*. The inner-shaft component 60 spatially corresponds to the installation opening 92. The inner-shaft component 60 is partially accommodated within the accommodation space 23 of the inner-sleeve assembly 20, and includes a fixing space 62 and at least one third engaging portion 64. The at least one third engaging portion 64 is disposed on a bottom end of the inner-shaft component 60 and spatially corresponds to the at least one second engaging portion 26 of the inner-sleeve assembly 20. When the inner-shaft component 60 is at least partially accommodated within the accommodation space 23 of the inner-sleeve assembly 20, the at least one third engaging portion 64 is located in the accommodation space 23 of the inner-sleeve assembly 20. The at least one third engaging portion 64 and the at least one second engaging portions 26 of the inner-sleeve assembly 20 correspond to each other, and are configured to restrict the inner-shaft component 60, so as to prevent the inner-shaft component 60 from being completely separated from the accommodation space 23 of the inner-sleeve assembly 20. Preferably but not exclusively, the second elastic component 30 includes a telescopic spring. The second elastic component 30 includes a first end 31 connected to the bottom portion 25 of the inner-sleeve assembly 20 and a second end 32 accommodated within the fixing space 62 of the inner-shaft component 60. The second elastic component 30 is constantly abutted between the inner-shaft component 60 and the inner-sleeve assembly 20, so that the at least one third engaging portion 64 of the inner-shaft component 60 is engaged with the at least one second engaging portion 26 of the inner-sleeve assembly 20. Preferably but not exclusively, the third elastic component 50 includes a metal elastic component. In the embodiment, the third elastic component 50 includes a fixed portion 52 and an engaging end 51, which are disposed at two opposite ends of the third elastic component 50. The fixed portion 52 is accommodated within the fixing space 62 of the inner-shaft component 60 and connected with the second end 32 of the second elastic component 30, so that the third elastic component 50 is fixed on the inner-shaft component 60, and the third elastic component 50 is moved with the inner-shaft component 60. Notably, in the embodiment, when the fixed portion 52 of the third elastic member 50 is accommodated within the fixing space 62 of the inner-shaft component 60 and the third elastic component 50 is fixed on the inner-shaft component 60, the engaging end 51 of the third elastic component 50 abuts the inner wall of the inner-sleeve 20 assembly due to the elasticity of third elastic component 50. Preferably but not exclusively, the engaging end 51 is a bent section of a metal elastic component. Since the guiding groove 22 is concavely formed on the inner lateral wall of the inner-sleeve assembly 20, when the third elastic component 50 is fixed on the inner-shaft component 60, the engaging end 51 of the third elastic component 50 constantly abuts the guiding groove 22.

In the embodiment, the guiding groove 22 includes a first fastening recess 22*a* and a second fastening recess 22*b*, which are configured as the engagement points between the engaging end 51 of the third elastic component 50 and the guiding groove 22, respectively. When the second elastic component 30 is constantly abutted between the inner-shaft component 60 and the inner-sleeve assembly 20, the at least one third engaging portion 64 of the inner-shaft component 60 is engaged with the at least one second engaging portion 26 of the inner-sleeve assembly 20. In that, the engaging end 51 of the third elastic component 50 is located at the first fastening recess 22*a* of the guiding groove 22. When the inner-shaft component 60 is subjected to a force and driven to abut the second elastic component 30, the engaging end 51 of the third elastic component 50 is driven by the inner-shaft component 60, and moved along the guiding groove 22 to the second fastening recess 22*b* of the guiding groove 22. In that, the at least one third engaging portion 64 of the inner-shaft component 60 and the at least one second engaging portion 26 of the inner-sleeve assembly 20 are separated from each other, and the inner-shaft component 60 is further received within the accommodation space 23 of the inner-sleeve assembly 20.

On the other hand, in the embodiment, the inner-sleeve assembly 20 is detachably accommodated within the accommodation seat 11 of the housing 10. When the inner-sleeve assembly 20 is located at the first position relative to the accommodation seat 11 of the housing 10, the bottom portion 25 of the inner-sleeve assembly 20 is attached to the bottom surface of the accommodation seat 11 of the housing 10, the two limiting portions 21*a*, 21*b* and the two first engaging portions 43*a*, 43*b* are engaged with each other, and the latching portion 44 of the latching component 40 passes through the lateral opening 12 of the housing 10 and is engaged with the fixed component 90. On the other hand, when the bottom portion 25 of the inner-sleeve assembly 20 is separated from the bottom surface of the accommodation seat 11 of the housing 10 and moved into the second position relative to the accommodation seat 11 of the housing 10, the two limiting portions 21*a*, 21*b* drive the latching component 40 to abut the two first elastic components 42*a*, 42*b* through the two first engaging portions 43*a*, 43*b*, and the latching portion 44 is moved into the housing 10 through the lateral opening 12 of the housing 10, so that the latching portion 44 and the fixed component 90 are separated. Moreover, in the embodiment, the two limiting portions 21*a*, 21*b* are for example but not limited to two corresponding triangular openings in communication with the accommodation space 23. When the latching portion 44 of the latching component 40 is subjected to a force to abut the two first elastic components 42*a*, 42*b*, the latching portion 44 of the latching component 40 is driven to pass through the lateral opening 12 of the housing 10 from the outside and moved inside the housing 10. The operating relationship of the related components in the push-and-pull latch device 1 will be described in the followings.

In the embodiment, the push-and-pull latch device 1 further includes a stopper 80. Preferably but not exclusively, with at least one first fastening component 81 such as a crew, the stopper 80 is disposed on the fixed component 90 of the object 9. In the embodiment, the stopper 80 spatially corresponds to the latching portion 44 of the latching component 40. When the latching portion 44 of the latching component 40 passes through the lateral opening 12 of the housing 10, the latching component 40 and the stopper 80 are engaged with each other, so as to block the movable component 91 from moving relative to the fixed component 90. Thus, it achieves the purpose of keeping the door or the drawer closed. Certainly, in other embodiment, the stopper 80 is omitted. When the latching portion 44 of the latching component 40 passes through the lateral opening 12 of the housing 10, the latching component 40 and the fixed component 90 of the object 9 are engaged with each other directly, so as to block the movable component 91 from moving relative to the fixed component 90 and achieve the purpose of keeping the door or the drawer closed. The present disclosure is not limited thereto.

In the embodiment, the inner-shaft component 60 further includes an installation end 61 and an operation component 63. Preferably but not exclusively, the operation component 63 is an I-shaped or T-shaped handle. The operation component 63 is disposed on the installation end 61 by a thread engagement method. In the embodiment, the installation end 61 and the operation component 63 of the inner-shaft component 60 spatially correspond to the installation opening 92 of the movable component 91. In addition, the operation component 63 is exposed out of the movable component 91 through the installation opening 92, so as to facilitate a user to push/pull the operation component 63. Moreover, in the embodiment, the push-and-pull latch device 1 further includes an adjusting component 73. Preferably but not exclusively, the adjusting component 73 is a spacer. The adjusting component 73 has an accommodation opening 74 and spatially corresponds to the installation opening 92. In the embodiment, the adjusting component 73 is configured to adjust the position of the operation component 63 relative to the movable component 91. For example, when the engaging end 51 of the third elastic component 50 is moved to the second fastening recess 22*b* of the guiding groove 22, the operation component 63 is received within the accommodation opening 74 of the adjusting component 73. In that, the operation component 63 is hidden in the installation opening 92 of the moving component 91 without being exposed out of the movable component 91. Moreover, for example, when the inner-shaft component 60 drives the inner-sleeve assembly 20 to move into the second position relative to the accommodation seat 11 of the housing 10, the operation component 63 is moved and exposed out of the accommodation opening 74 of the adjusting component 73. Certainly, the present disclosure is not limited thereto. In the embodiment, the housing 10 further includes at least one second fastening component 72. Preferably but not exclusively, the at least one second fastening component 72 passes through the installation hole 13 of the housing 10 and the cover 70 to fasten the housing 10 on the movable component 91. In the embodiment, the adjusting component 73 is sleeved in the installation opening 92 of the movable component 91, and the operation component 63 of the inner-shaft component 60 is aligned to the accommodation opening 74 of the adjusting component 73. Since the operation component 63 can be selectively hidden or held, the user can drive the inner-shaft component 60 to move relative to the inner-sleeve assembly 20 or the housing 10 through a simple pressing action. The relative positions between the related components are switched to achieve the functions of opening, closing or locking the door or the drawer.

Please refer to FIGS. 6 to 9. In the embodiment, with the push-and-pull latch device 1 mounted on the movable component 91 of the object 9, the movable component 91 and the fixed component 90 can be maintained in a closed state, as shown in FIGS. 6 and 7. At this time, the bottom portion 25 of the inner-sleeve assembly 20 is attached to the bottom surface of the accommodation seat 11 of the housing 10, and the inner-sleeve assembly 20 is located at the first position relative to the accommodation seat 11 of the housing 10. In addition, the two limiting portions 21*a*, 21*b* of the inner-sleeve assembly 20 are engaged with the two first engaging portions 43*a*, 43*b* of the latching component 40, and the latching portion 44 of the latching component 40 is abutted by the force from the two first elastic components 42*a*, 42*b*. The latching portion 44 of the latching component 40 passes through the lateral opening 12 of the housing 10 to engage with the fixed component 90, so as to block the movable component 91 from moving relative to the fixed component 90. On the other hand, since the second elastic component 30 is constantly abutted between the inner-shaft component 60 and the inner-sleeve assembly 20, and the at least one third engaging portion 64 of the inner-shaft component 60 is engaged with the at least one second engaging portion 26 of the inner-sleeve assembly 20. The engaging end 51 of the third elastic component 50 is located at the first fastening recess 22*a* of the guiding groove 22, and the operation component 63 is exposed out of the movable component 91 for the user to perform pressing or holding and pulling operations. When the user presses the operation component 63, the inner-shaft component 60 is forced to resist the second elastic component 30, and the engaging end 51 of the third elastic component 50 is driven to move along the guiding groove 22 to the second fastening recess 22*b* at the same time. With the engagement between the engaging end 51 of the third elastic component 50 and the second fastening recess 22*b* of the guiding groove 22, the elastic force of the second elastic element 30 disposed between the inner-shaft component 60 and the inner-sleeve assembly 20 is resisted, so that the least one third engaging portion 64 of the inner-shaft component 60 is separated from the at least one second engaging portion 26 of the inner-sleeve assembly 20, and the inner-shaft component 60 is further accommodated within the accommodation space 23 of the inner-sleeve assembly 20 at the same time, as shown in FIGS. 8 and 9. As a result, the operation component 63 is displaced into the accommodation opening 74 of the adjusting component 73, and hidden in the installation opening 92 of the movable component 91 without being exposed out of the installation opening 92. The movable component 91 and the fixed component 90 are maintained in a latched state, thereby achieving the purpose of locking. When the user presses the operation component 63 again, the engaging end 51 of the third elastic component 50 is moved along the guiding groove 22 to the first fastening recess 22*a*, and the elastic force of the second elastic component 30 is restored to act between the inner-shaft component 60 and the inner-sleeve assembly 20 again. As a result, the inner-shaft component 60 is displaced relative to the inner-sleeve assembly 20, the at least one third engaging portion 64 of the inner-shaft component 60 is engaged with the at least one second engaging portion 26 of the inner-sleeve assembly 20, and the operation component 63 is maintained and exposed out of the movable component 91. It allows the user to perform the pressing or holding and pulling operations, as shown in FIGS. 6 and 7.

Please refer to FIGS. 6, 7, 10 and 11. As mentioned above, in the embodiment, the engaging end 51 of the third elastic component 50 is engaged with the first fastening recess 22*a* of the guiding groove 22, and the second elastic component 30 is constantly abutted between the inner-shaft component 60 and the inner-sleeve assembly 20. Meanwhile, the at least one third engaging portion 64 of the inner-shaft component 60 is engaged with the at least one second engaging portion 26 of the inner-sleeve assembly 20, and the operation component 63 is exposed out of the movable component 91 for the user to perform the pressing or holding and pulling operations, as shown in FIGS. 6 and 7. When the user holds the operation component 63 and pulls the operation component 63, since the at least one third engaging portion 64 of the inner-shaft component 60 is engaged with the at least one second engaging portion 26 of the inner-sleeve assembly 20, the inner-shaft component 60 is driven by the inner-sleeve assembly 20 and moved to the second position relative to the accommodation seat 11 of the housing 10, as shown in FIGS. 10 and 11. When the inner-sleeve assembly 20 is displaced relative to the accommodation seat 11 of the housing 10, the two limiting portions 21*a*, 21*b* of the inner-sleeve assembly 20 drive the latching component 40 to move through the two first engaging portions 43*a*, 43*b* of the latching component 40 and resist the two first elastic component 42*a* and 42*b*, so that the latching portion 44 passes through the lateral opening 12 and is moved into the housing 10. At this time, the latching portion 44 is separated from the stopper 80 on the fixed component 90, and the movable component 91 is forced to move or rotate relative to the fixed component 90, thereby providing the function of opening the object 9. When the user releases the operation component 63, the elastic force of the two first elastic components 42*a*, 42*b* is restored to push against the latching component 40, the latching portion 44 passes through the lateral opening 12 of the housing 10, and the two first engaging portions 43*a*, 43*b* of the latching component 40 push against the two limiting portions 21*a*, 21*b* of the inner-sleeve assembly 20 at the same time, so that the inner-sleeve assembly 20 is forced to move to the first position relative to the accommodation seat 11 of the housing 10, as shown in FIG. 6. Notably, since the two limiting portions 21*a*, 21*b* include the triangular openings in communication with the accommodation space 23, when the latching portion 44 of the latching component 40 resists the two first elastic components 42*a*, 42*b*, the latching portion 44 of the latching component 40 is moved into the housing 10 through the lateral opening 12 of the housing 10. In other words, when the movable component 91 is maintained in the open state, the user can push the movable component 91 directly, and the stopper 80 on the fixed component 90 pushes the latch portion 44 of the latching component 40 by the closing action, so that the movable component 91 and the fixing component 90 are changed into the closed state, as shown in FIG. 7. Certainly, the present disclosure is not limited thereto and not redundantly described herein.

Figure 12:
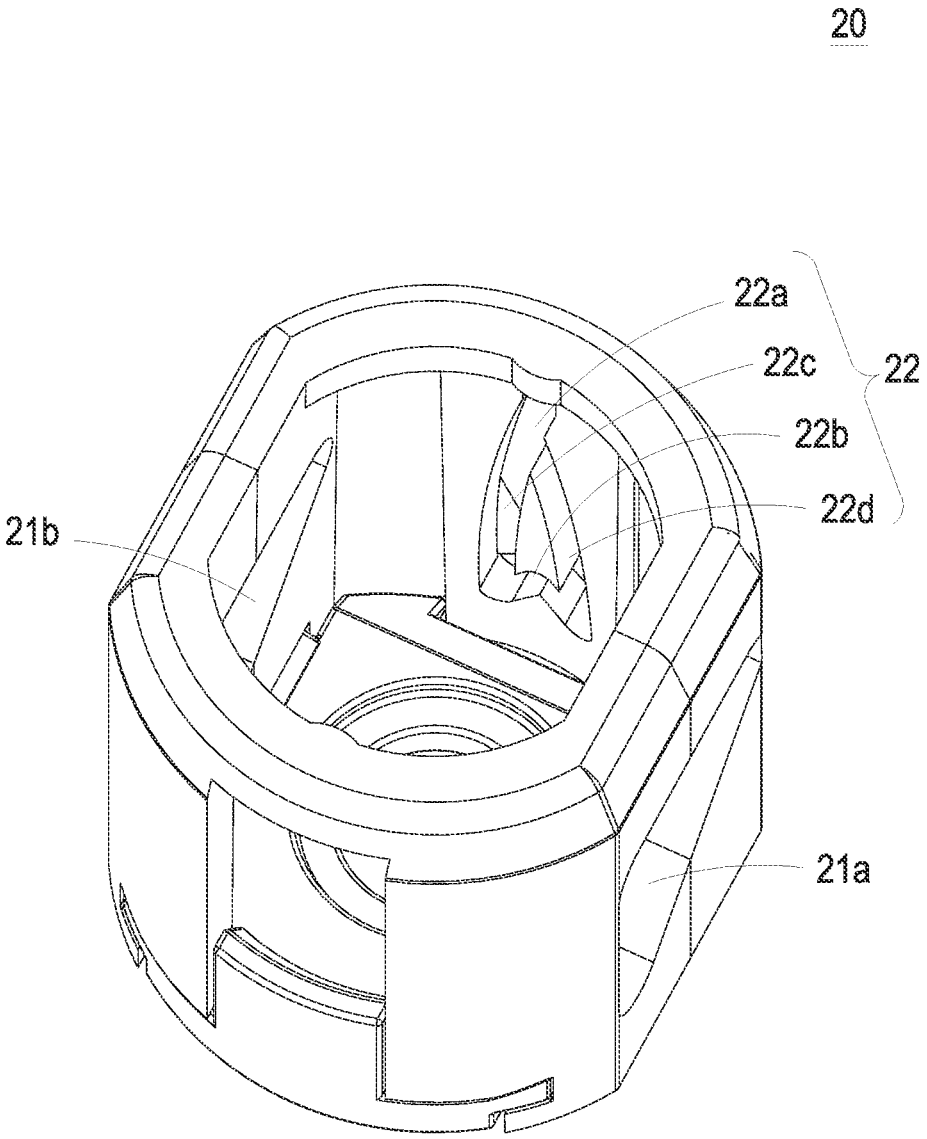
FIG. 12 is a perspective view illustrating the inner-sleeve assembly of the push-and-pull latch device according to the embodiment of the present disclosure.
Figure 13:
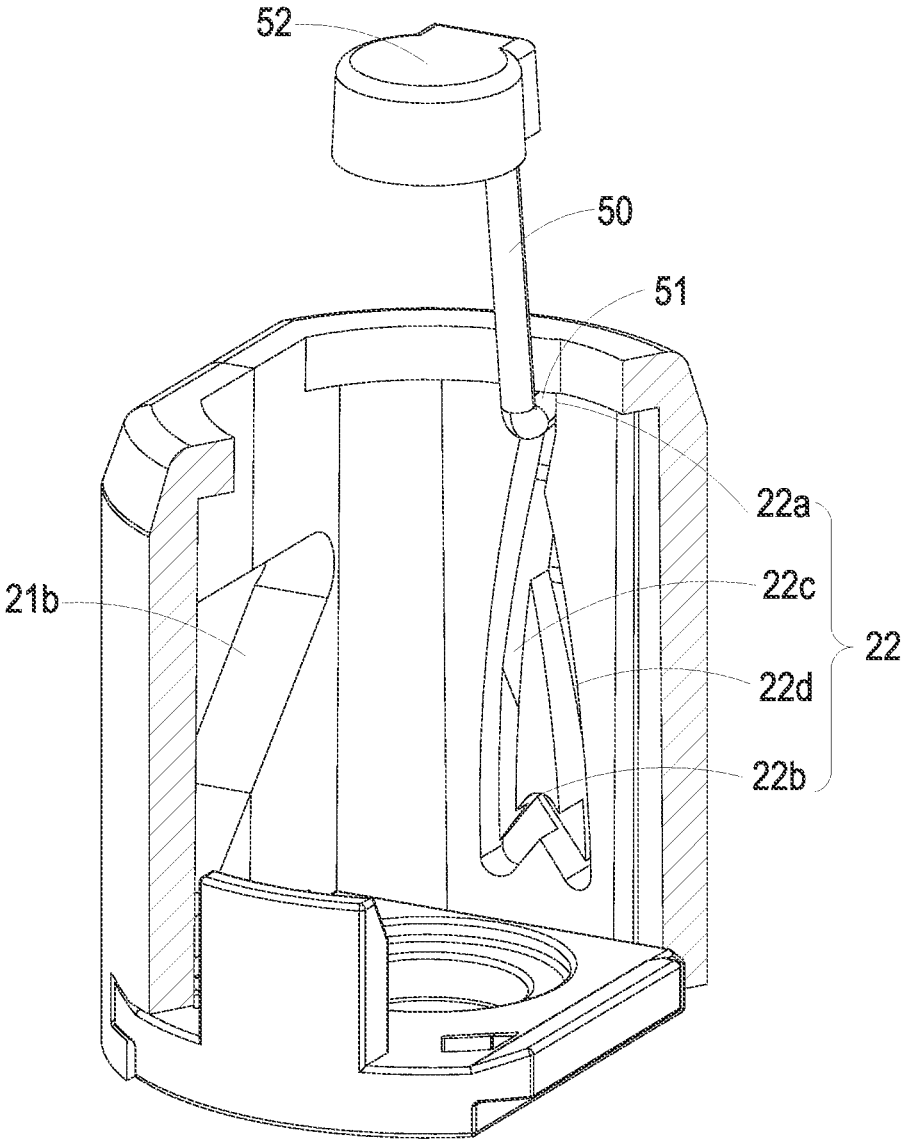
FIG. 13 shows the engaging end of the third elastic component is located at the first fastening recess of the guiding groove in the push-and-pull latch device.
Figure 14:
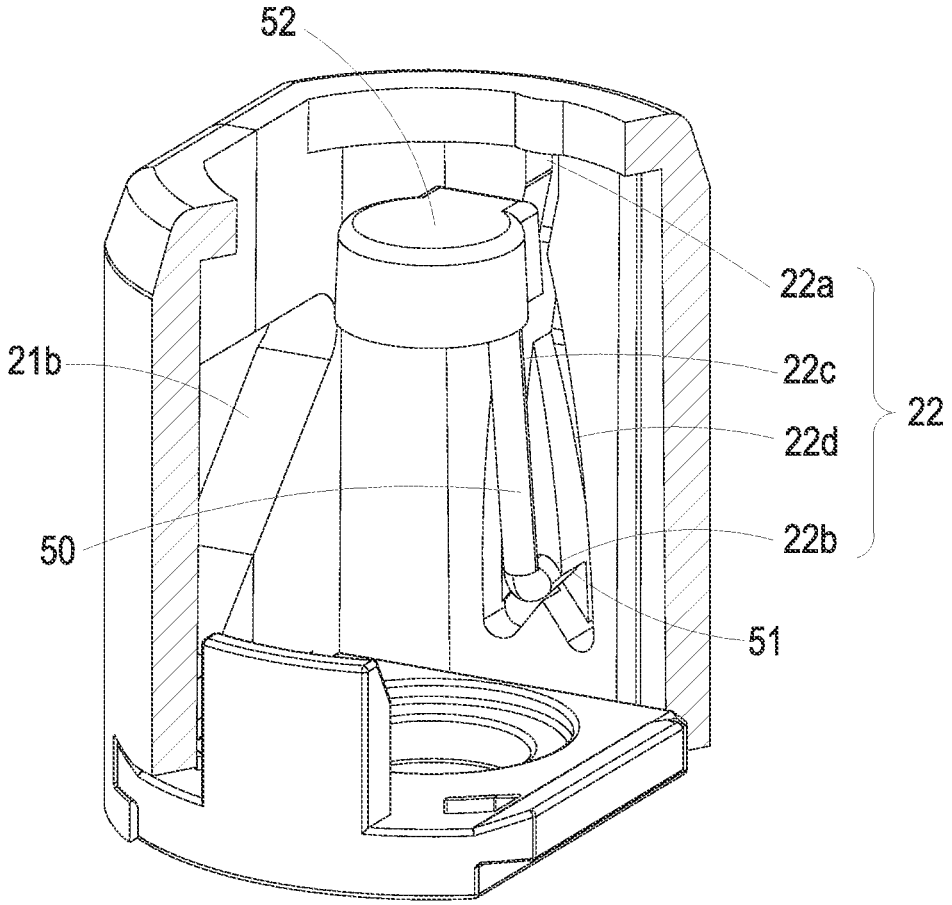
FIG. 14 shows the engaging end of the third elastic component is located at the second fastening recess of the guiding groove in the push-and-pull latch device.

FIG. 12 is a perspective view illustrating the inner-sleeve assembly of the push-and-pull latch device according to the embodiment of the present disclosure. FIG. 13 shows the engaging end of the third elastic component is located at the first fastening recess of the guiding groove in the push-and-pull latch device. FIG. 14 shows the engaging end of the third elastic component is located at the second fastening recess of the guiding groove in the push-and-pull latch device. In the embodiment, the guiding groove 22 further includes a first channel 22*c* and a second channel 22*d*. The first channel 22*c* is communicated between the first fastening recess 22*a* and the second fastening recess 22*b*, and the second channel 22*d* is communicated between the second fastening recess 22*b* and the first fastening recess 22*a*. In the embodiment, the function of the first channel 22*c* and the second channel 22*d* is communicated between the first fastening recess 22*a* and the second fastening recess 22*b*. Preferably but not exclusively, the first channel 22*c* and the second channel 22*d* are partially crossed or joined with each other. It is adjustable according to the practical requirements. The present disclosure is not limited thereto. In the embodiment, the first channel 22*c* includes a plurality of inclined surfaces, and each of the inclined surfaces of the first channel 22*c* increases in height along a direction from the first fastening recess 22*a* to the second fastening recess 22*b*. In that, a non-reverse sawtooth structure is formed on the bottom surface of the first channel 22*c*. Similarly, the second channel 22*d* includes a plurality of inclined surfaces, and each of the inclined surfaces of the second channel 22*d* increases in height along a direction from the second fastening recess 22*b* to the first fastening recess 22*a*. In that, a non-reverse sawtooth structure is formed on the bottom surface of the second channel 22*d*. As shown in FIG. 13, when the engaging end 51 of the third elastic component 50 of the push-and-pull latch device 1 is located in the first fastening recess 22*a* of the guiding groove 22, the engagement effect of the engaging end 51 of the third elastic component 50 and the first fastening recess 22*a* of the guiding groove 22 is generated to limit the second elastic component 30 or maintain the distance between the inner-shaft component 60 and the inner-sleeve assembly 20. When the user pushes the inner-shaft component 60 to move relative to the inner-sleeve assembly 20, the engaging end 51 of the third elastic component 50 is moved steadily from the first fastening recess 22*a* to the second fastening recess 22*b*, and then the engaging end 51 of the third elastic component 50 is engaged with the second fastening recess 22*b* of the guiding groove 22, as shown in FIG. 14. When the user presses the inner-shaft component 60 to move relative to the inner-sleeve assembly 20 again, the engaging end 51 of the third elastic component 50 is moved steadily from the second fastening recess 22*b* to the first fastening recess 22*a*, and then the engaging end 51 of the third elastic component 50 is engaged with the first fastening recess 22*a* of the guiding groove 22. In other embodiments, the arrangements of the first fastening recess 22*a*, the second fastening recess 22*b*, the first channel 22*c* and the second channel 22*d* are adjustable according to the practical requirements. The present disclosure is not limited thereto.

In summary, the present disclosure provides a push-and-pull latch device applied to a door lock or a drawer lock. With operations of an inner-shaft component and an inner-sleeve assembly, engaging portions of related components are driven to space apart or engage. In that, the latch device is driven by a simple pressing action in a limited operating space and it is conducive to achieving the functions of opening, closing or locking a door or a drawer. The overall structure is compact. It is easy to assemble, maintain and operate. The latch device has a compacted structure, and can be assembled easily. By driving the inner-shaft component and the elastic components to move relative to a guiding groove of the inner-sleeve assembly or the housing, the relative positions of the related components are switched. The operation component of the latch device can be hidden or held, and the user can drive the engaging portions of the related components in the latch device to space apart or engage by a simple pressing action. It is conducive to achieving the functions of opening, closing or locking a door or a drawer. Moreover, positioning of the inner-shaft component and the inner-sleeve assembly is further implemented by the movement of the elastic component relative to the guiding groove of the inner-sleeve assembly or the housing, to replace the conventional elastic tenon assembly. The complexity and difficulty of assembly are simplified effectively. The guiding groove includes a plurality of inclined surfaces segmented to form a non-reverse sawtooth structure. It is beneficial for one end of the elastic component to constantly abut the guiding groove, and to move steadily along the guiding groove to be positioned at a specific position. In that, the engaging portions of the related components are driven to space apart or engage, to achieve the operations of opening, closing or locking. Compared with the conventional tenon structure, the combination of the elastic component and the guiding groove is easier to assemble, replace or maintain. It enhances the competitiveness of the push-and-pull latch device effectively.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A push-and-pull latch device for being disposed on an object, wherein the object comprises a movable component and a fixed component, the movable component comprises an installation opening, and the push-and-pull latch device comprises:

a housing fixed to the movable component, wherein the housing comprises an accommodation seat and a lateral opening, and the lateral opening is in communication with the accommodation seat;

a latching component comprising a latching portion, two arms and two first engaging portions, wherein the two arms spatially correspond to each other, the latching portion is connected to the two arms, the two first engaging portions are disposed on two corresponding sides of the two arms, and the latching portion spatially corresponds to the lateral opening;

two first elastic components spatially corresponding to the two arms and disposed between the housing and the corresponding one of the two arms, wherein the first elastic component is constantly abutted between the corresponding one of the two arms and the housing, so that when the latching portion is passed through the lateral opening and engaged with the fixed component, the movable component is blocked from moving relative to the fixed component;

an inner-sleeve assembly detachably accommodated within the accommodation seat and located between the two corresponding sides of the two arms, wherein the inner-sleeve assembly comprises an accommodation space, a bottom portion, a first opening, two limiting portions, at least one second engaging portion and a guiding groove, wherein the two limiting portions spatially correspond to the two first engaging portions, the first opening spatially corresponds to the bottom portion and is in communication with the accommodation space, the guiding groove faces to the accommodation space, the at least one second engaging portion is disposed adjacent to the first opening, and the guiding groove comprises a first fastening recess and a second fastening recess;

an inner-shaft component spatially corresponding to the installation opening, partially accommodated within the accommodation space of the inner-sleeve assembly, and comprising a fixing space and at least one third engaging portion, wherein the at least one third engaging portion is disposed on a bottom end of the inner-shaft component and spatially corresponds to the at least one second engaging portion;

a second elastic component comprising a first end connected to the bottom portion of the inner-sleeve assembly and a second end accommodated within the fixing space of the inner-shaft component, and constantly abutted between the inner-shaft component and the inner-sleeve assembly, so that the at least one third engaging portion is engaged with the at least one second engaging portion; and a third elastic component comprising a fixed portion and an engaging end, wherein the fixed portion is accommodated within the fixing space, and the engaging end constantly abuts the guide groove, wherein when the second elastic component is constantly abutted between the inner-shaft component and the inner-sleeve assembly, the at least one third engaging portion is engaged with the at least one second engaging portion, and the engaging end is located at the first fastening recess, wherein when the inner-shaft component is driven to abut the second elastic component and move the engaging end to the second fastening recess of the guiding groove, the at least one third engaging portion is separated from the at least one second engaging portion.

2. The push-and-pull latch device according to claim 1, wherein when the inner-sleeve assembly is located at a first position relative to the accommodation seat, the two limiting portions and the two first engaging portions are engaged with each other, and the latching portion passes through the lateral opening and is engaged with the fixed component, wherein when the inner-sleeve assembly is moved to a second position relative to the accommodation seat, the two limiting portions drive the latching component to abut the two first elastic components through the two first engaging portions, and the latching portion is moved into the housing through the lateral opening, so that the latching portion and the fixed component are separated.

3. The push-and-pull latch device according to claim 1, further comprising a stopper disposed on the fixed component and spatially corresponding to the latching portion of the latching component, wherein when the latching component passes through the lateral opening, the latching component and the stopper are engaged with each other, so as to block the movable component from moving relative to the fixed component.

4. The push-and-pull latch device according to claim 3, wherein the stopper further comprises at least one first fastening component configured to fasten the stopper on the fixed component.

5. The push-and-pull latch device according to claim 1, wherein the inner-shaft component comprises an installation end and an operation component, wherein the operation component is disposed on the installation end, spatially corresponds to the installation opening, and is exposed out of the movable component through the installation opening, so as to facilitate a user to push/pull the operation component.

6. The push-and-pull latch device according to claim 5, further comprising an adjusting component including an accommodation opening and spatially corresponding to the installation opening, wherein when the engaging end is moved to the second fastening recess of the guiding groove, the operation component is received within the accommodation opening, wherein when the inner-shaft component drives the inner-sleeve assembly to move into the second position relative to the accommodation seat, the operation component is moved and exposed out of the accommodation opening.

7. The push-and-pull latch device according to claim 1, wherein the housing further comprises a cover including a second opening, and the inner-shaft component passes through the second opening.

8. The push-and-pull latch device according to claim 1, wherein the housing further comprises at least one second fastening component configured to fasten the housing on the movable component.

9. The push-and-pull latch device according to claim 1, wherein the guiding groove comprises a first channel and a second channel, the first channel is communicated between the first fastening recess and the second fastening recess, and the second channel is communicated between the second fastening recess and the first fastening recess.

10. The push-and-pull latch device according to claim 9, wherein the first channel comprises a plurality of inclined surfaces, and each of the inclined surfaces of the first channel increases in height along a direction from the first fastening recess to the second fastening recess.

11. The push-and-pull latch device according to claim 10, wherein the second channel comprises a plurality of inclined surfaces, and each of the inclined surfaces of the second channel increases in height along a direction from the second fastening recess to the first fastening recess.

12. The push-and-pull latch device according to claim 1, wherein the two limiting portions comprise a triangular opening, respectively.

13. The push-and-pull latch device according to claim 1, wherein when the latching portion of the latching component is subjected to a force and driven to push the two first elastic components, the latching portion is moved to pass through the lateral opening and received within the housing.

14. The push-and-pull latch device according to claim 1, wherein the two first elastic components and the second elastic component comprise a telescopic spring, respectively.

15. The push-and-pull latch device according to claim 1, wherein the third elastic component comprises a metal elastic component.

* * * * *